US009694383B2

(12) United States Patent
Jurcevic

(10) Patent No.: US 9,694,383 B2
(45) Date of Patent: Jul. 4, 2017

(54) APPLICATOR FOR IN PARTICULAR MANUALLY CONTROLLED APPLICATION OF A LIGHT-CURABLE COMPOSITE MATERIAL AND ARRANGEMENT OF A LIGHT SOURCE ON THE APPLICATOR

(71) Applicant: KDS Holding GmbH, Wesseling (DE)

(72) Inventor: Dinko Jurcevic, Köln (DE)

(73) Assignee: KDS Holding GmbH, Wesseling (DE)

( * ) Notice: Subject to any disclaimer, the term of this patent is extended or adjusted under 35 U.S.C. 154(b) by 140 days.

(21) Appl. No.: 14/414,128

(22) PCT Filed: Jul. 11, 2013

(86) PCT No.: PCT/DE2013/100258

§ 371 (c)(1),
(2) Date: Jan. 12, 2015

(87) PCT Pub. No.: WO2014/008894

PCT Pub. Date: Jan. 16, 2014

(65) Prior Publication Data

US 2015/0174604 A1 Jun. 25, 2015

(30) Foreign Application Priority Data

Jul. 12, 2012 (DE) ..... 20 2012 102 583 U

(51) Int. Cl.
*B65D 5/66* (2006.01)
*B05C 17/005* (2006.01)
(Continued)

(52) U.S. Cl.
CPC ..... *B05C 17/0052* (2013.01); *B05C 1/06* (2013.01); *B05C 17/00* (2013.01);
(Continued)

(58) Field of Classification Search
CPC ..... B05C 17/0052; B05C 17/00; B05C 17/00583; B05C 1/06; F21K 9/61;
(Continued)

(56) References Cited

U.S. PATENT DOCUMENTS 2,547,450 A * 4/1951 du Pont ..... B65D 51/248 222/113
3,184,587 A * 5/1965 Quijada ..... A47G 19/24 200/60
(Continued)

FOREIGN PATENT DOCUMENTS

DE 852437 B 1/1952
DE 8709115 U1 10/1987
(Continued)

OTHER PUBLICATIONS

DE202011109785—English Translation, machine generated; Aug. 2016.*
DE 20206121—English Translation, machine generated; Aug. 2016.*

*Primary Examiner* — J. Casimer Jacyna
*Assistant Examiner* — Benjamin R Shaw
(74) *Attorney, Agent, or Firm* — Michael Soderman

(57) ABSTRACT

The invention relates to an applicator (100) for in particular manually controlled application of a light-curable composite material contained in a reservoir (1), wherein the reservoir (1) is deformable at least in some areas and the light-curable composite material is present in the reservoir, and having an outlet opening (3.1) for the light-curable material and at least one light source for curing the light-curable material, wherein according to the invention the reservoir is resiliently compressible and the wall region thereof in the actuating region (16) has a reduced height (H) in the Z-direction and the wall region is compressible in a preferred direction (Z-direction). The at least one light source can be arranged
(Continued)

on the applicator in such a manner that the LED-lamp, when actuated, shines toward the outlet opening (3.1). The invention further relates to the arrangement of at least one light source on the applicator (100), wherein according to the invention at least one light source is arranged in such a manner that the light of the light source, when the latter is actuated, shines toward the leading end of the applicator (100), casting light onto the emerging light-curable material.

9 Claims, 7 Drawing Sheets

(51) Int. Cl.

| | |
|---|---|
| ***B05C 1/06*** | (2006.01) |
| ***B05C 17/00*** | (2006.01) |
| ***F21V 21/088*** | (2006.01) |
| ***F21K 9/20*** | (2016.01) |
| ***F21K 9/61*** | (2016.01) |

(52) U.S. Cl.
CPC ..... *B05C 17/00583* (2013.01); *F21K 9/20* (2016.08); *F21K 9/61* (2016.08); *F21V 21/088* (2013.01)

(58) Field of Classification Search
CPC ..... F21K 9/20; F21V 21/088; A61C 5/062; A61C 5/064
USPC ..... 222/113; 362/551; 156/349, 60
See application file for complete search history.

(56) References Cited

U.S. PATENT DOCUMENTS

| | | | | |
|---|---|---|---|---|
| 5,098,292 | A * | 3/1992 | Lazarof | A61C 19/004 433/141 |
| 6,835,064 | B2 * | 12/2004 | Burtscher | A61C 19/004 433/229 |
| 7,096,617 | B2 * | 8/2006 | Bydalek | B67D 1/0872 222/113 |
| 8,591,133 | B2 * | 11/2013 | Ho | A45D 34/041 401/209 |
| 2005/0026103 | A1 * | 2/2005 | Wasylucha | A61C 3/005 433/29 |
| 2008/0144426 | A1 * | 6/2008 | Janssen | A61C 5/064 366/130 |
| 2008/0205038 | A1 * | 8/2008 | Becnel | B25H 7/04 362/118 |
| 2010/0213212 | A1 * | 8/2010 | Custodis | A45D 33/32 222/113 |
| 2014/0284352 | A1 * | 9/2014 | Offermann | G03F 7/16 222/113 |

FOREIGN PATENT DOCUMENTS

| | | | | |
|---|---|---|---|---|
| DE | 68909092 | U1 | 10/1989 | |
| DE | 19935292 | A1 | 2/2001 | |
| DE | 20206121 | U1 * | 8/2002 | B05C 17/00526 |
| DE | 10217306 | A1 | 11/2003 | |
| DE | 102007022205 | A1 | 11/2008 | |
| DE | 102007060247 | A1 | 6/2009 | |
| DE | 102009019515 | A1 | 11/2010 | |
| DE | 102010060422 | A1 | 1/2012 | |
| DE | 202011109785 | U1 * | 5/2012 | A61C 5/062 |
| FR | 2908965 | A1 | 5/2008 | |
| JP | 2005118207 | A | 5/2005 | |

* cited by examiner

APPLICATOR FOR IN PARTICULAR MANUALLY CONTROLLED APPLICATION OF A LIGHT-CURABLE COMPOSITE MATERIAL AND ARRANGEMENT OF A LIGHT SOURCE ON THE APPLICATOR

CROSS-REFERENCE TO RELATED APPLICATIONS

This application is the U.S. national stage of International Application No. PCT/DE2013/100258 filed on Jul. 11, 2013, and claims the benefit thereof. The international application claims the benefit under 35 USC 119 of German Application No. DE 20 2012 102 583.3 filed on Jul. 12, 2012; all applications are incorporated by reference herein in their entirety.

BACKGROUND

This invention relates to an applicator for in particular manually controlled application of a light-curable composite material according to the preamble of the initial patent claim 1 and an arrangement of a light source on the applicator.

Materials of different viscosities are meted out via an applicator for various purposes. The materials can be liquid or viscous. The applicator can be manually operated depending on the application and intended use.

To apply customary glues, hot glue guns are known, as an example, that can be provided with lighting to illuminate the work area in accordance with DE 102 17 306 A1. The curing of the glue that is dispensed requires a long period of time, however. Furthermore, a risk of injury exists because of the high temperature of the hot glue gun.

Hand-held equipment for dispensing and mixing viscous fluids, which is used in the dental sector for instance, is also known. A solution of that type is described in DE 199 35 292 A1. To illuminate the treatment area, a light guide is provided for a pistol-type hand-held device that can be connected to a source via a coupler. The light guide is provided with a rotating lens that bundles the light in the treatment area. A system comprising an application device in the form of a painting roller or spray gun for applying liquids to a surface to which the liquid can be applied from a work area is described in DE 10 2007 060 247 A1. The area 20 is specifically illuminated by a lighting unit that brings about a contrast between the coated and uncoated surfaces.

The above-mentioned solutions are not intended to be used to apply light-curable material, and the lighting equipment is accordingly not intended to be used for that and is also not suitable for curing the dispensed material.

A dispenser designed in the form of a pen for applying a liquid rust converter that has an output part for the liquid and a cap that can be put in a removable way on the output part is known from the document DE 87 09 115 U1. The cap is provided with an abrasive surface that can be used to remove loose paint and rust from a surface that the rust converter is supposed to be applied to. The output part has elastic walls made of a polymer material that surround an elongated container for holding a stock of rust converter, as well as an output tip made of a polymer material that has a housing mounted on the reservoir with a through-hole that is connected to an opening leading into the reservoir. The circumference of a valve element in the housing can make tight contact with an inner surface that forms an end part of the through-hole; a tip runs through the outlet end of the through-hole when the valve element makes tight contact with this inner surface. A pre-loading unit presses the valve element into the tight seat on the inner surface forming the end part of the through-hole and permits movement of the valve element into an open position in which it is at a distance from the inner surface so that rust converter can flow past it. The valve element can be put into its open position by pressing its tip onto a surface from which rust is to be removed. The flow of the rust converter at the open valve element can be strengthened by pressing inwards on the elastic walls forming the reservoir. If a desired amount of liquid has been applied, the dispenser is lifted off the surface, causing the valve element to tightly seal off the liquid in the container again. The cap can now be put onto the output part again in such a way that a hollow area in it takes in and protects the tip arrangement. This solution is not suitable for an application of light-curable material, because the light-curable material is usually used to combine components and it is therefore not desirable in many cases for a certain amount of pressure to be applied to the components to dispense it, as is the case in the above-mentioned solution. Furthermore, no LED exists because it is also not necessary.

A dispenser that is suitable for meting out flowing liquid glue, either in the form of a film or in the form of a series of small points or lines, wherein the dispenser has a container body that can be pressed together and has an outlet in the form of an elongated, cylindrical nozzle, is described in DE 89 09 092.6. The dispenser has a control cap with a coaxial tube that runs internally from the bottom of the flat, upper surface of the control cap, and the hole seats the nozzle. Moreover, the nozzle is provided with a positioning pin that works together with a screw groove in the inner surface of the tube to the effect that a rotation of the control cap by hand in a direction around the longitudinal axis of the nozzle causes the pin to travel along the groove in a direction against the end of the groove that is at a distance form the flat, upper surface of the control cap. This causes the nozzle to be pulled back into the dispenser until the tip of the nozzle is no longer projecting out of the flat, upper surface; rotation in the opposite direction causes the pin to run along the groove in a direction against the end of the groove that is closer to the flat, upper surface. This causes the tip of the nozzle to project out of the flat, upper surface of the control cap. The base of the nozzle is attached to the walls of the container body via a flexible membrane in order to make movement of the nozzle of that type possible. When the nozzle is in the retracted position in which its tip is not projecting out of the flat, upper surface of the control cap, this surface acts as a spreading or distributing tool so that the glue coming out of the nozzle can be spread out into a film. When, in contrast, the nozzle is in its forward position in which it is projecting out of the flat, upper surface of the control cap, glue from the nozzle tip can be dispensed in the form of a fine line or in the form of a series of points. The design structure of this dispenser is relatively complex. Furthermore, it is a drawback that a removable sealing cap is required to close up the dispenser. A light source is also unnecessary in this solution, because customary glue is dispensed here and not light-curable material.

A flash unit for curing light-curable materials, a method and a set are described in the document DE 10 2010 060 422 A1. A flash is generated with that; a light guide that is flexible in areas can be used for that. The flash unit is designed in the form of a ballpoint pen, for example, that can be switched on or off via the press of a button. The flash unit can have a reservoir for holding light-curable material that is arranged in a housing. The unit can be designed in the form of a pen with a reservoir for the light-curable material, for instance. An LED lamp is provided at the end of the housing opposite the outlet opening.

The housing has to be rotated crosswise to its longitudinal axis after the light-curable material is dispensed. The dispensed material is then cured by switching on the LED lamp.

A set that has at least one dispensing device with light-curable material that is seated in a removable way in a housing is known from a document DE 20 2011 109 785 U1. Moreover, a light-emitting device for curing the light-curable material is arranged on the housing in the form of an LED lamp. A dispensing unit for dispensing the light-curable material is connected in a detachable way to the dispensing device; the dispensing unit and/or a dosing channel of the dispensing unit for dispensing the light-curable material has a detachable closure. The dosing channel and the light-emitting device are formed or provided on two opposite end areas of the set; the housing has at least one opening for hand-controlled dosing of the light-curable material and a device for removable seating of the light-emitting device. A drawback here is that the reservoir in the form of the dispensing device is additionally encased in a housing. The fact that the LED is arranged on the end of the housing opposite the dosing channel likewise brings about an unfavorable effect on the handling process, because this makes it necessary to turn the set around after the light-curable material is dispensed and to only start the curing process at that point by actuating the LED.

It can happen that the light-curable material runs in an undesirable way before it is cured in the two above-mentioned solutions. Furthermore, insufficiently precise manual pressure regulation can be realized.

DETAILED DESCRIPTION

The object of this invention is to propose an applicator for manually controlled application of a light-curable composite material that has a simple construction design, that allows the light-curable material to be cured immediately after it is applied and that provides a lighting device for that. Moreover, a precise manual pressure effect on the reservoir is ensured in order to evenly dispense the curable material.

The problem as per the invention is solved by an applicator with the features of claim 1. Advantageous design forms follow from the sub-claims.

An applicator for applying light-curable composite material contained in the applicator by means of pressure with the fingers is consequently being proposed in accordance with the invention. The applicator has a manually deformable reservoir that contains the light-curable composite material. The applicator can, moreover, comprise a preferably non-detachable closure unit that the light-curable composite material flows through when it is dispensed.

The applicator for in particular manually controlled application of a light-curable composite material contained in the reservoir, wherein the reservoir is deformable at least in areas, has the light-curable composite material in the reservoir and is provided with an outlet opening for the light-curable material and at least one light source for curing the light-curable material; the reservoir has, in accordance with the invention, a wall area extending along a longitudinal axis (x direction) that can be elastically pressed together in an actuation area by manual pressure crosswise to the longitudinal axis, wherein the wall area in the actuation area has a reduced height in the z direction and the wall area can be pressed together in a preferred direction (z direction), and it essentially regains its starting shape after being pressed together. Defined gripping is possible because of the reduced cross-section, and the preferred direction for squeezing ensures precise proportioning. In addition, the reservoir can have an enlarged width in the y direction in the actuation area, causing a grip area and actuation area that are even better and more secure to be formed. In accordance with a further design form of the invention, the at least one light source is fastened to the applicator, the light source illuminates in the direction of the outlet opening when it is actuated or the light source is arranged or attachable to any arbitrary position of the applicator, and a light guide radiates/emits the light emitted by the light source onto the material dispensed from the applicator, which makes it possible to immediately cure the light-curable material when it is dispensed.

Furthermore, an arrangement of a light source on an applicator for in particular manually controlled application of a light-curable composite material contained in a reservoir is provided as per the invention; at least one light source is arranged on or in the applicator or can be connected to the applicator in such a way that the light of the light source illuminates the dispensed, light-curable material and cures it when the light source is actuated in the direction of the front end of the applicator. The at least one light source is designed to be an LED lamp with one or more LEDs, it can be fastened/latched into position on the applicator in a detachable or non-detachable way or integrated into the applicator, and it radiates directly in the direction of the outlet opening of the applicator. A light guide can be connected to the light source that radiates/emits the light emitted by the light source onto the material dispensed by the applicator and/or the LED lamp can be put from a fastened position on the applicator in which the LED points away from the outlet opening into a fastened position on the applicator in which the LED radiates in the direction of the outlet opening or is connected to a light guide that radiates/emits the light emitted by the light source/the LED onto the material dispensed from the applicator. The applicator as per the invention has at least one reservoir. The reservoir is, as an example, set up directly on the reservoir behind the closure unit to hold in a detachable way a snap-on device with an integrated LED lamp when light-curable composite materials are used.

The use of the expression "can be" or "can have" etc. in the following remarks is understood to be synonymous with "is preferably" or "preferably has" etc., and it is supposed to explain an embodiment in accordance with the invention. Further developments of this invention are the subject matter of sub-claims and embodiments in each case. Embodiments as per the invention can have one or more of the features specified below.

In certain embodiments in accordance with the invention, the applicator has a non-detachable closure unit and a receptacle for the closure unit via which the light-curable material is dispensed or applied. The receptacle of the closure unit is—especially or preferably, in whole or essentially—made of a first material or has a first material here, whereas the reservoir is—especially, preferably, wholly or essentially—made of a second material or has a material of that type. The second material is different from the first material. In some embodiments in accordance with the invention, the receptacle of the closure unit is made of a plastic or has a material of that type. In certain embodiments in accordance with the invention, the reservoir constitutes the main component of the applicator. In certain embodiments in accordance with the invention, the reservoir is made of material that is softer than the receptacle of the closure unit or has at least a softer material. In some of the embodiments in accordance with the invention, this design form can advantageously contribute to or ensure that the seal tightness between the reservoir and the receptacle unit of the closure unit is maintained even when there is elastic deformation of the reservoir, for instance when pressure is applied to it. In some of the embodiments as per the invention, the reservoir has a wall thickness in a range of 0.4 mm to 1.2 mm, preferably from 0.5 to 0.9 mm, in at least one area here and/or in its outer surface or in a main area of those in each case. These areas have proved to be especially suitable with regard to the desired deformability and the required strength and load-bearing capacity. In certain embodiments in accordance with the invention, the reservoir has light-curable material that cures by means of radiation in a range of 300 to 600 nanometers (nm), especially in a range of 395 to 470 nm. In some of the embodiments in accordance with the invention, when light-curable composite materials are used, the reservoir is made of an opaque material. The opaque material is preferably, at least or especially opaque to light for a radiation range of 300 to 600 nanometers (nm), especially in a range of 395 to 470 nm. A dispensing unit that is provided with the closable outlet opening is connected to the reservoir via a detachable or non-detachable fastener. The dispensing unit has a receptacle element that is attached to the reservoir and that interacts with a closure unit that has the outlet opening. A run-around ring is provided on the closure unit, which is preferably non-detachable. The run-around ring serves to shade the closure unit from the light radiation of the LED lamp. Hardening of the light-curable plastic on the closure unit and therefore clogging of the closure unit as well are to be prevented in that way.

In the embodiment as per the invention, the closure unit and the LED lamp are designed to be or provided on the same end area of the reservoir or on opposite end areas. The lamp/LED lamp has one or more LEDs. The light-curable composite material can be cured immediately after it is dispensed or while it is being dispensed via a simple actuation of the LED lamp, for instance via manual actuation of a switch with a finger, so it is possible to both dispense the light-curable composite material and also cure it via the LED (in sequence or at the same time) with only one hand. A snap-on device with an LED lamp that is integrated/that can be accommodated can be arranged in a detachable or non-detachable way, for instance, on the reservoir or a housing of the applicator. The non-detachable attachment can be accomplished, for example, via gluing, a thermal bond or the like. The reservoir can be appropriately prepared.

In certain embodiments in accordance with the invention, the reservoir has a device to detachably hold the snap-on device with the integrated LED lamp, or there is a device on the housing or on the reservoir where the LED lamp or the LED housing can be clipped in. This device is designed to be a snap-on device in some of the embodiments in accordance with the invention.

BRIEF DESCRIPTION OF THE DRAWINGS

The instant invention is explained in more detail below with the aid of drawings. The following are shown in the figures.

DETAILED DESCRIPTION OF THE PREFERRED EMBODIMENTS

Figure 1:
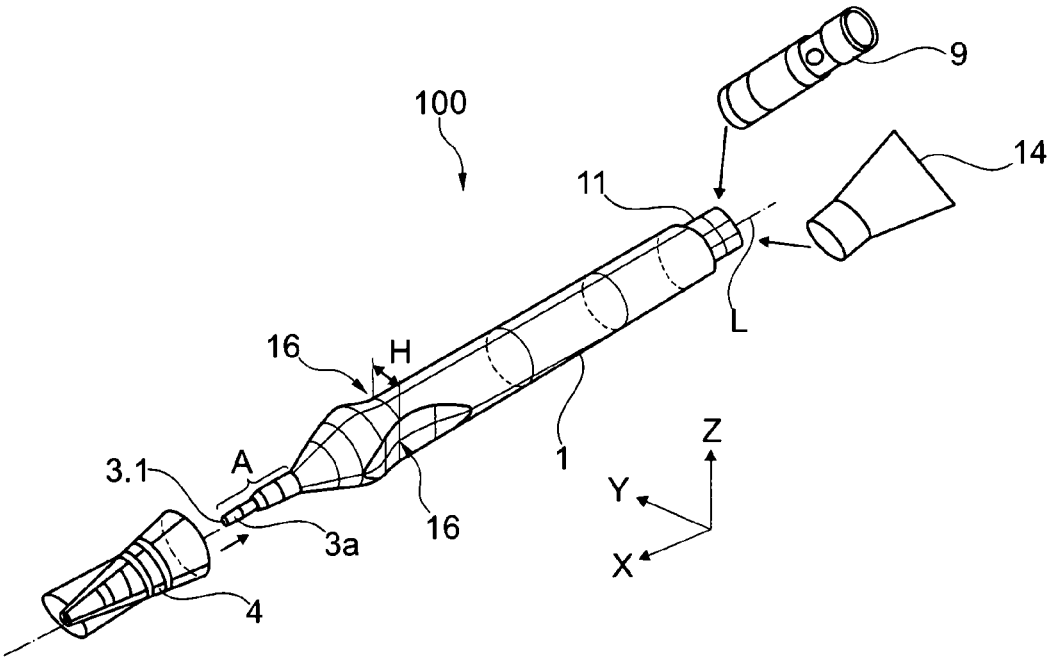
FIG. 1 shows an example of a dispensing pen in accordance with the invention in a spatial presentation with possible components.

A variant of a dispensing pen/applicator 100 is presented in FIG. 1. The reservoir 1 has a chemical composite material (not visible here). When pressure is manually applied to the reservoir 1, for instance by pressing the deformable reservoir 1 from the outside in an actuation area 16 with two fingers gripping on opposite sides of the circumference, the light-curable material on the outlet side in the dosing channel, not shown here, of the dispensing unit A is fed or pressed into it and output via the outlet opening 3.1. The dispensing unit is firmly connected to the reservoir or, as the case may be, designed to be a single piece with it. A separate sealing cap 4 is provided here. A dispensing tip 3*a* of the dispensing unit A that the dosing channel, not shown, with the outlet opening 3.1 leads through is pushed into the reservoir 1 and connected to it. Various snap-on devices or thread types can be provided in the reservoir 1 and the dispensing tip 3*a* for that. The attachment can also be realized in the form of a press fit or a latch, for example. The dispensing tip 3*a* of the dispensing unit A can be made of plastic or a metal. Alternatively, it is possible to design the dispensing tip 3*a* to be a single piece with the reservoir 1.

The reservoir 1 in this example is made of a first material, for instance a soft polyethylene (e.g. HDPE—high density polyethylene), or has a first material of that type. The dispensing tip is comprised of a second material, e.g. a harder polymer, but is in any case made of a material that is harder relative to the first material or has a material of that type. Both the first material and the second material can be selected such that they are opaque—preferably, at least, or in particular in a light wavelength range of 300 to 600 nanometers (nm)—if a chemical composite material is used that is cured via light polymerization (or is processed, e.g. via a black or other type of coating or coloring), in order to protect the light-curable material of the reservoir 1 and the dispensing tip 3*a* from undesired curing via the effect of light. The material of the sealing cap 4, which is designed to be a stand-up cap here, is optionally or preferably likewise opaque, especially in a light wavelength range of 300 to 600 nanometers (nm), in order to protect the light-curable material against undesired curing via the effect of light before it is dispensed from the outlet opening 3.1 The outlet opening 3.1 is closed up with the sealing cap 4. Latching is preferably done via a snap-on closure. An LED lamp 9, a smoothing device 14 like a spatula or a different type of mounted tool can optionally be put on the prepared mounting area 11 opposite the dispensing tip 3*a*. It is also possible to put an adapter element on the prepared mounting area 11 to which the LED lamp 9 and the smoothing device 14/the spatula can be fastened.

After being dispensed, the chemical, light-curable composite material is cured via radiation with the light of the LED, via LED light in the light wavelength range between 360 and 470 nanometers (nm) in this example. This LED light is preferably provided by a commercially available LED lamp 9, which can be mounted on the reservoir 1 in a detachable way. A light-curable material or a different chemical compound material can be processed with the smoothing device 14/the mountable spatula before curing by means of UV radiation from the LED lamp or via self-curing.

The reservoir 1 is designed to be elongated, especially in the form of a pen, and consequently extends along a longitudinal axis L in the x direction. It has an actuation area 16 that is reduced in height in the y direction and that consequently forms a depression in such a way that fingers gripping this area on opposite sides can get a good hold, and the actuation area can be pressed together in a preferred direction, in the y direction here. A secure grip and precise proportioning are ensured because of this design of the actuation area 16.

Figure 2:
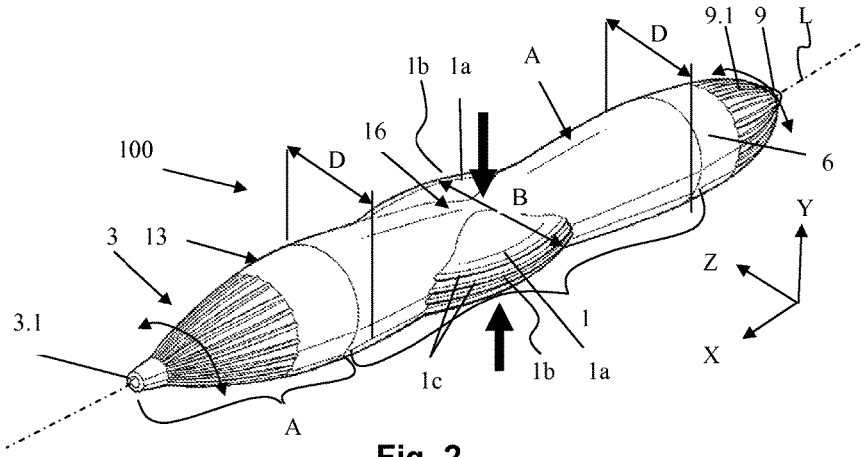
FIG. 2 shows another embodiment of a dispensing pen in a three-dimensional presentation.
Figure 3:
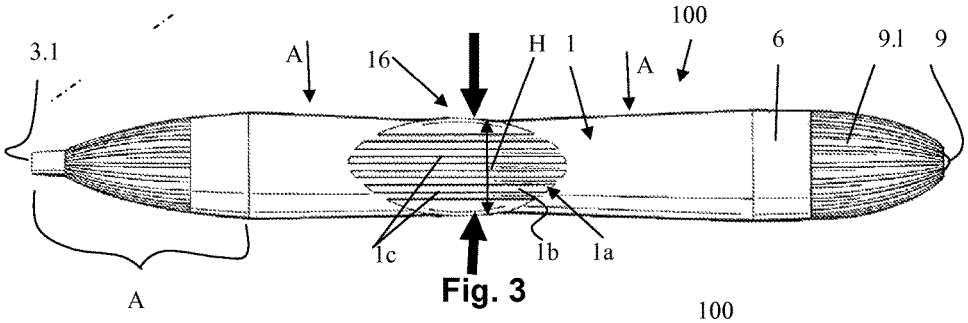
FIG. 3 shows the side view in accordance with FIG. 2.
Figure 4:
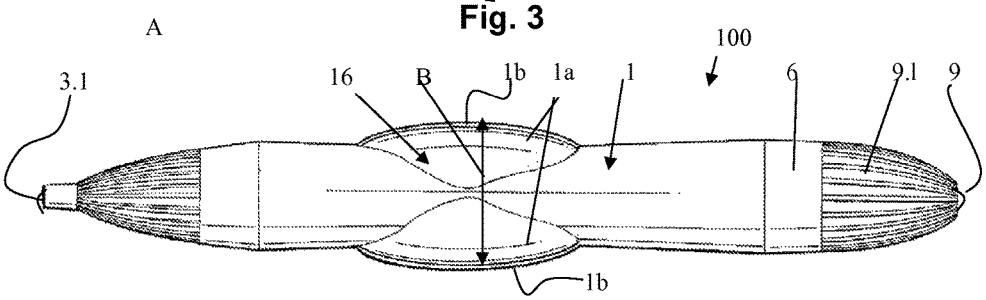
FIG. 4 shows the top view in accordance with FIG. 5.

Another variant of an applicator 100 in accordance with the invention is shown in FIGS. 2 to 4. The hollow reservoir 1 that holds the light-curable material has an essentially circular cross-section with a diameter D at both ends. The dispensing unit A with the outlet opening 3.1 connects to the end of the reservoir 1; the LED lamp 9, which is seated in an LED housing 9.1, is arranged on the other end. The dispensing unit A is comprised here of a closure unit 3 with the outlet opening 3.1 and a receptacle unit 13. The closure unit 3 forms a turn-lock closure with which the outlet opening 3.1 can be opened and closed. A sealing cap as in FIG. 1 is not required because of that. The LED housing 9.1 is connected via a ring-shaped adapter element 6 to the reservoir 1. The LED 9 is switched on or off with a rotary movement of the LED housing 9.1.

In the actuation area 16, the cross-section of the reservoir 1 is reduced in the y direction from the diameter D to a height H (see FIG. 12) and the width is increased from the diameter D to a width B (see FIGS. 2 and 4). The reservoir 1 can be securely gripped because of that and can be pressed together in a preferred direction in the actuation area 16, which makes precise proportioning possible. The thick arrows in FIGS. 2 and 3 indicate the actuation direction. FIGS. 2 to 4 show that two opposing, bead-like wall areas 1*a*, which essentially have a radius-shaped curve in their opposing external areas 1*b*, extend radially outwards in a wing-like fashion from the area with the height H in the actuation area 16 Reinforcement ribs 1*c* that extend in the longitudinal direction and that thereby increase the stability of the reservoir 1 in the longitudinal direction and, on the other hand, support actuation crosswise to that in the preferred direction, are provided in the opposing, external areas 1*b* with radius-shaped curvature.

Figure 5:
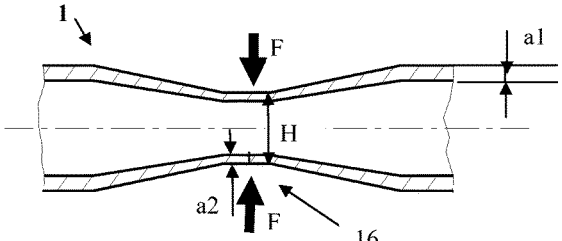
FIG. 5 shows a partial longitudinal section A-A in accordance with FIG. 3.
Figure 6:
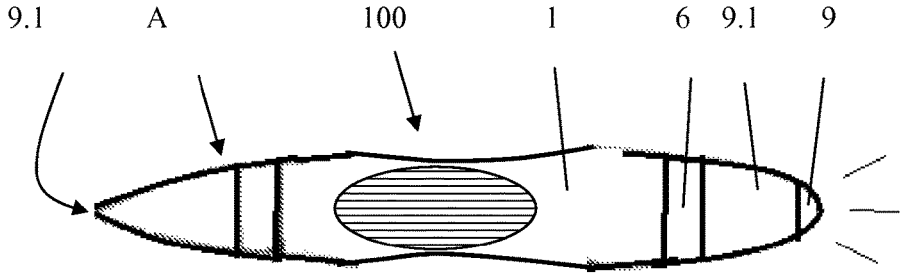
FIG. 6 shows a side view of an applicator to which the LED housing is attached via a ring-shaped adapter element on the end that is opposite the outlet opening.
Figure 7:
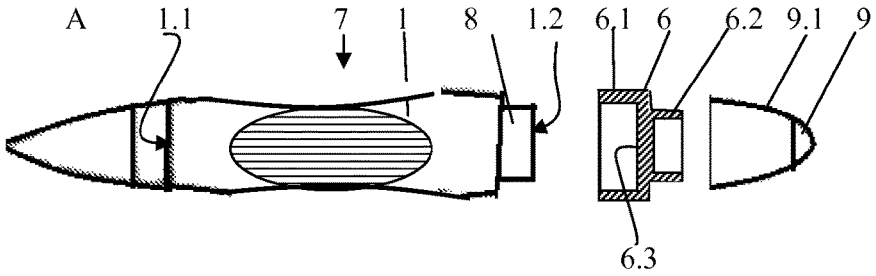
FIG. 7 shows a side view of an applicator in which the adapter element and the LED housing are presented separately.

A partial longitudinal section A-A in accordance with FIG. 2 in the area of reduced height H in the actuation area 16 is shown in FIG. 5. It is evident from this that the reservoir 1 can have a wall that decreases in height from a wall thickness a1 to a wall thickness a2 in the direction of the actuation area 16; the actuation force F of the fingers (not shown) directed towards one another is reduced because of that. FIG. 6 shows once again a basic diagram of the side view of an applicator 100. The LED housing 9.1 with the LED 9 (as well as electronics, switch and battery) arranged in it are connected to the reservoir 1 of the applicator via a ring-shaped adapter element 6 at the end opposite the outlet opening 3.1 of the dispensing unit A. FIG. 7 illustrates that the adapter element 6 and the LED housing 9.1 can be advantageously removed from the reservoir 1 of the applicator 100. The reservoir 1 has an area 8 with a reduced diameter for this that serves to accommodate the adapter element 6, which has a first ring-shaped element 6.1 to fit onto the area 8. The adapter element 6 has, in the direction of the LED housing 9.1, a reduced-diameter area 6.2 that serves to accommodate the LED housing 9.1, which grips over the reduced-diameter area 6.2. The Adapter element 6 and reservoir 1 or, as the case may be, the LED housing 9.1 and adapter element 6 can optionally be joinable with one another, preferably in a removable fashion, via a plug-in connection, a clip connection, a screw connection etc.; the form elements required for that will then be provided, of course. In a preferred variant, the adapter element 6 is provided in the area of the ring-shaped element 6.1 with an internal thread and the reduced-diameter area 8 is provided with an external thread corresponding to that, so the adapter element 6 can be screwed onto the reduced-diameter area 8 of the reservoir 1.

The reduced-diameter area 6.2 of the adapter element 6 preferably has an external thread, and the LED housing 9.1 has an internal thread corresponding to that and is consequently capable of being screwed onto the adapter element 6. An undesignated shoulder of the adapter element 6 constitutes a limit stop for the LED housing 9.1. Furthermore, the adapter element 6 has a wall or base 6.3 running cross-wise. If the reservoir 1 has a second opening 1.2 to fill/refill light-curable material, in addition to the first opening 1.1 associated with the dispensing unit A, on the end that is opposite the dispensing unit A, the adapter element 13 will serve to close up the second opening 8.2 via the screw connection and the wall 13.3.

Moreover, the wall 13.3 can serve as a unit for switch contact to actuate the LED 5. If the LED housing 3 is somewhat at a distance to the shoulder/limit stop through the screw connection, the switch contact is open and the LED 5 is switched off. If the LED housing 3 as shown in FIG. 6 is screwed down to the limit stop of the adapter element 6, the switch contact is closed and the LED 5 is illuminated. The circuit can also be designed in such a way, of course, that the LED 5 is off when the LED housing 3 at the limit stop is off, and it is switched on when the LED housing is moved away from the adapter element or, alternatively, a pushbutton switch can be used.

If a first opening 1.1 and a second opening 1.2 are provided at both ends of the reservoir 1, the reservoir 1 can be filled after the adapter element is detached from the direction of the second opening 1.2. Furthermore, the adapter can be designed to be symmetrical and have a thread on both ends, so attention does not have to be paid to an assembly direction for fastening the dispensing unit and the adapter element.

In that case, a reduced-diameter section with a thread, which is not shown here, that the dispensing unit A is screwed onto also exists then in the direction of the dispensing unit A; this reduced-diameter section is then essentially designed like the reduced-diameter area 8. The manufacturing and assembly costs are reduced since attention does not have to be paid to any installation direction for fastening the dispensing unit A and the adapter element 6 because of the symmetrical design and identical end areas of the reservoir. The reservoir 1 can be connected to the dispensing unit A at either end and to the LED housing at the other respective end. In accordance with FIGS. 8 to 11, it is also possible to arrange the reservoir 1 in a housing 20, preferably in an exchangeable way. The housing 20 has two opposing recesses 20.1; the reservoir 1 can be manually pressed together because of that, as indicated with the thick arrows in FIG. 8. The dispensing unit A is then attached to the outlet opening 3.1 on the housing 20. The light-curable material accommodated in the reservoir 1, which is still liquid or viscous, is pressed through the outlet opening 3.1 because the reservoir is pressed together. The LED 9 with the LED housing 9.1 is clipped onto the end of the housing 20 opposite the outlet opening 3.1 via a snap-on device 7 and can, as indicated by the double arrow, be removed from that and inserted again. The LED 9 can be switched on and off via a pushbutton switch 23.

The light-curable material is illuminated with the LED, and the material is cured because of that, after the output of the light-curable material by either rotating the applicator 100 crosswise to its longitudinal axis L or by removing the LED 9 from the snap-on device 7 and illuminating the dispensed material.

Figure 8:
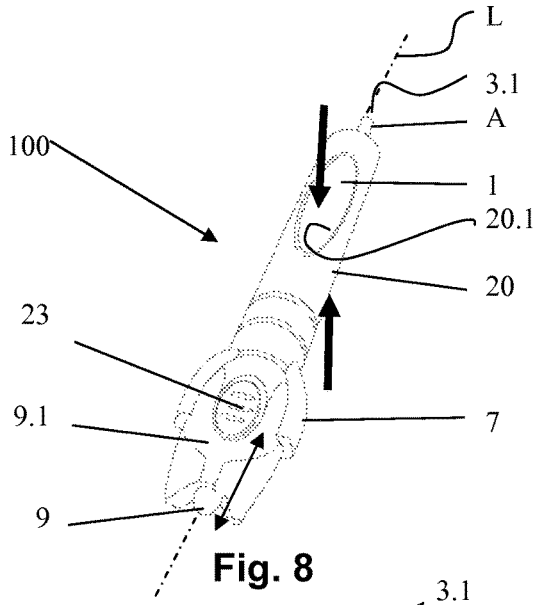
FIG. 8 shows a three-dimensional presentation of a further embodiment of an applicator with a housing.
Figure 9:
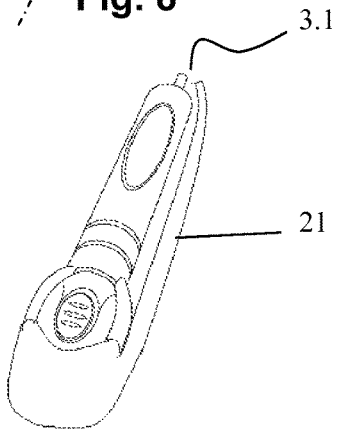
FIG. 9 shows an applicator in accordance with FIG. 6 with an adapted fiber-optic cable.

A fiber-optic cable 21 that diverts the light emitted by the LED 9 towards the front in the direction of the outlet opening 3.1, as schematically shown in FIG. 9, can be coupled via an undesignated plug connection to an applicator 100 in accordance with FIG. 8 over the area of the LED 9 to illuminate the light-curable material while it is being dispensed.

Figure 10:
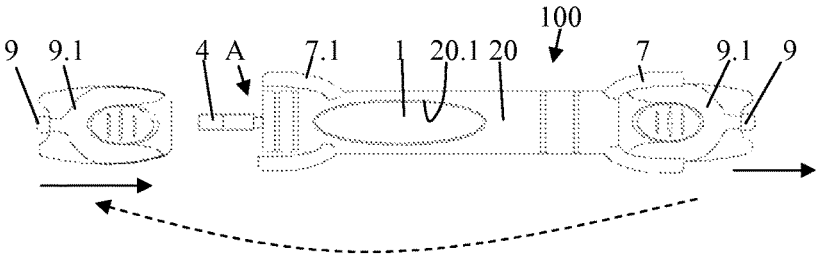
FIG. 10 shows a side view of an applicator with a housing and an LED that can be switched to a different location.

A further variant is shown in FIG. 10. A second snap-on device 7.1 is provided in this on the housing 20 in the direction of the dispensing unit A, which can be closed up here via a sealing cap 4. The LED housing 9.1 can now be removed from the snap-on device 7 and be inserted into the second snap-on device 7.1 with the LED 9 pointing in the direction of the dispensing unit A. It is now possible to illuminate the light-curable material with the LED 9 while it is being dispensed. It is naturally also possible to arrange an LED (with the corresponding LED housing) directly in the snap-on device 7 and in the second snap-on device 7.1 or to also permanently integrate these two LEDs in the housing 1 so that an LED will light up in the direction of the outlet opening 3.1 and an LED will light up in the direction turned away from that.

Figure 11:
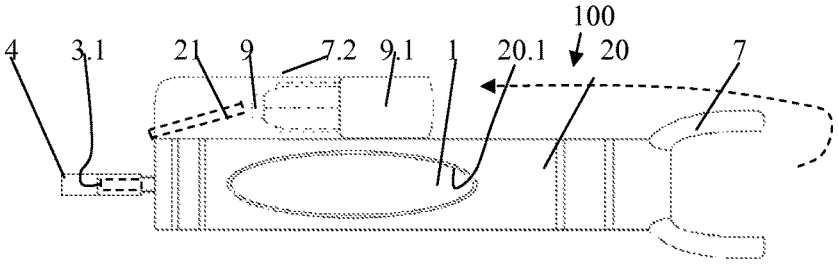
FIG. 11 shows a side view of an applicator with a housing and an LED that can be switched to a different location—combined with a fiber-optic cable.

FIG. 11 shows a variant of an applicator 100 with a housing 20 and an accommodated reservoir 1, which has a snap-on device 7 to detachably clip in an LED housing on the end opposite the dispensing unit A, as in FIGS. 8 to 10. In accordance with FIG. 11, the LED housing 9.1 was removed from the snap-on device (clip device) 7 and inserted into a housing-like receptacle 7.2 so that the LED 9 borders on a fiber-optic cable 21. This leads from the LED 9 through the receptacle 7.2, and its end on the side of the outlet points towards the outlet opening 3.1. When a switch (not visible here) is actuated, the LED 9 is switched on and its emitted light radiates through the fiber-optic cable 21 onto the material dispensed through the outlet opening 3.1. The outlet opening 3.1 can be closed up here with a sealing cap 4.

It is likewise possible to integrate the LED 9 into the housing 20 and to lay the fiber-optic cable 21 from it in the direction of the outlet opening 3.1 and, if necessary, to additionally seat an LED 9 in the snap-on device 7. The light guide/the fiber-optic cable is preferably a glass-fiber cable.

Figure 12:
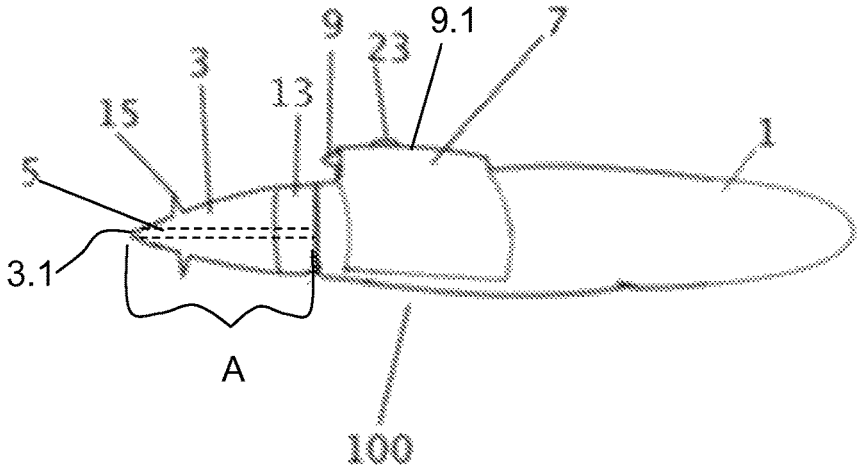
FIG. 12 shows a three-dimensional presentation of an applicator with a clipped-on LED lamp.

FIG. 12 shows a further embodiment of an applicator 100 as per the invention in a spatial presentation with all of the components. The reservoir 1 has a light-curable composite material (not shown here). A dispensing unit A that is comprised of a closure unit 3 with an outlet opening 3.1 and a receptacle unit 13 is connected to the reservoir 1. The closure unit 3 has a shielding ring 15 on the circumference to protect the light-curing material after it leaves the outlet opening 3.1 from undesired curing because of the light effect of the LED lamp 9, and it consequently prevents clogging of the dosing channel 5 in the dispensing unit A during the curing of the dispensed light-curing material/composite material if the radiation of the LED lamp can at least penetrate the material of the closure unit 3 in the area of the outlet opening 3.1. The LED lamp 9 is arranged in an LED housing 9.1 and preferably connected in a removable way with the reservoir 1 via a snap-on device 7. The LED lamp 9 illuminates when actuated through the shielding 15 at an angle tilted towards the longitudinal axis of the applicator in the direction of the outlet opening 3.1 A switch 23 that is integrated into the LED housing 9.1 serves to turn the LED lamp 9 on and off. The closure unit 3 is connected in a non-detachable way to the receptacle unit 13 via a snap thread. The receptacle unit 13 is connected to the reservoir 1 via a screw connection. Various thread types can be provided in the reservoir 1 and the receptacle unit 13 for that. Alternatively, it is possible to realize the connection via a snap connection. The attachment can also be realized in the form of a press fit or a latch, for example.

The receptacle unit 13 and the closure unit 3 can be made of plastic or a metallic material.

The reservoir 1 in this example is made of a first material, for instance a soft polyethylene (e.g. LDPE—low density polyethylene), or has a material of that type. The receptacle unit 13 is preferably comprised of a second material, e.g. a harder polymer, but is in any case made of a material that is harder relative to the first material of the reservoir or has a material of that type.

In the case of an application of pressure on the reservoir 1 on the peripheral side, which is preferred, for instance via manual pressure with one's fingers from the outside on the deformable reservoir 1, the light-curable material is fed or pressed into the dispensing unit A. The light-curing material goes through the receptacle unit 13 into the closure unit 3 and is transported via it through a dosing channel 5, schematically indicated with dashed lines, through the outlet opening 3.1. The LED lamp 9 can be actuated during this process so that the light-curable material that is dispensed is immediately cured. A rotation of the applicator 100 to cure the dispensed, light-curable glue/material can therefore be omitted. Because only one processing path is required for the application and simultaneous curing, 50% of the processing time is saved compared to solutions in which the material is first applied over the processing path and the same path is followed once again after that for curing via an LED.

After being dispensed, the light-curable composite material is cured by light, via LED light in this example in the optical wavelength range between 395 and 470 nanometers (nm). This LED light is provided by the LED lamp 7 integrated into the snap-on device, which can be put in a removable or non-removable way on the reservoir 1.

Figure 13:
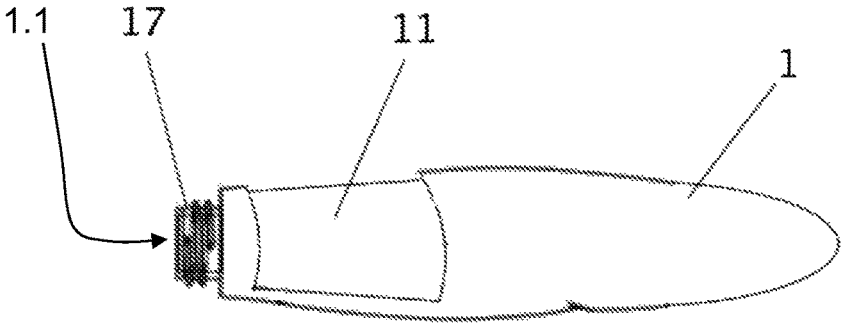
FIG. 13 shows a reservoir 1 that has a prepared mounting area for the snap-on device of the LED.

The reservoir 1 that has a prepared mounting area 11 on the peripheral side onto which a snap-on device 7 (see FIGS. 1 and 6) with an LED lamp 9 integrated into an LED housing 9.1 can be clipped is shown in FIG. 13. The reservoir 1 has an opening 1.1 on one end via which the light-curable material is output into the dispensing unit, not shown here, when there is peripheral pressure on the reservoir 1. A thread 17 is provided on the side of the opening 1.1 that the dispensing unit (not shown here) can be screwed onto.

Figure 14:
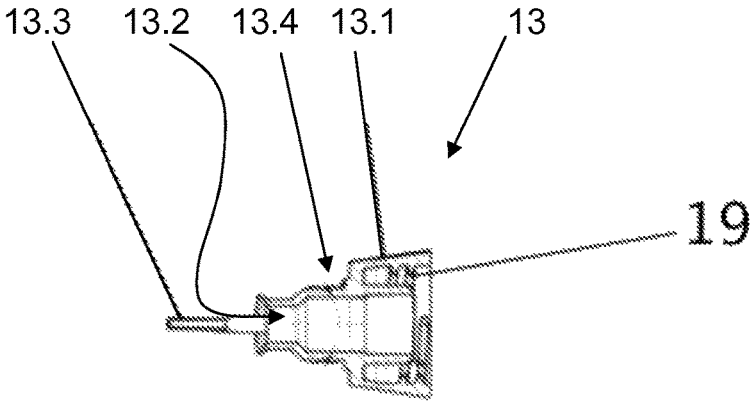
FIG. 14 shows the receptacle unit of the dispensing unit.

The receptacle unit 13 of the dispensing unit A is shown in a longitudinal section in FIG. 14. The receptacle unit 13 has a fastening ring 13.1 with an internal thread 19 that can thereby be fastened to the reservoir, not shown here, via a screw connection. Lateral outlet openings 13.2 are provided, as well as a massive tip 13.3. The receptacle unit 13 has an external thread 13.4 with a snap-on closure (not visible here) to fasten the closure unit.

Figure 15:
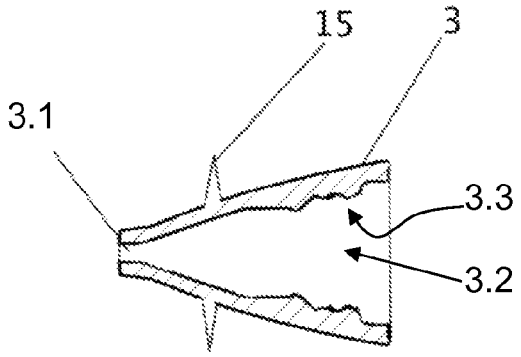
FIG. 15 shows the closure unit of the dispensing unit.

In accordance with FIG. 15, the closure unit 3 is designed with a tapered through-hole opening 3.2; the outlet opening 3.1 is at its end. An internal thread 3.3 with locking elements, not shown, which is screwed onto the external thread 13.4 and then locked in place in a non-detachable way is designed to be at the end opposite the outlet opening 3.1; the closure unit 3 can still be rotated and can be moved in the longitudinal direction in accordance with the pitch of the thread.

Figure 16:
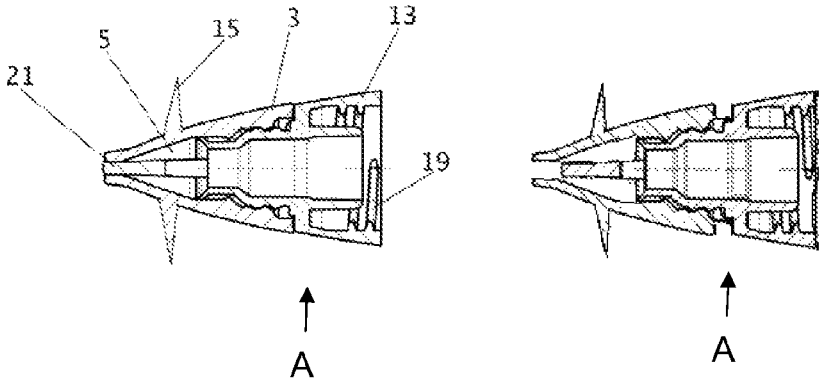
FIG. 16 shows the receptacle unit and the closure unit assembled as the dispensing unit in the closed state (left) and the open state (right)
Figure 17:
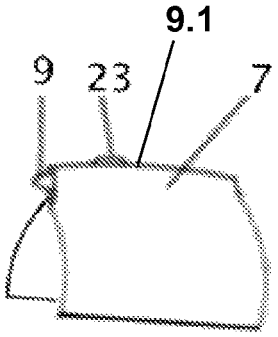
FIG. 17 shows a presentation of the snap-on device with the LED.

The undesignated internal diameter of the outlet opening 3.1 essentially corresponds to the external diameter of the massive tip 13.3 of the receptacle unit 13 shown in FIG. 3. When assembled, the massive tip 13.3 engages in the outlet opening 3.1 when the dispensing unit A is closed in accordance with the left-hand presentation in FIG. 16; the outlet opening is closed because of that and material cannot be dispensed. When the closure unit 3 is rotated, it is moved to the left due to the pitch of the thread in accordance with the right-hand presentation. The massive tip 13.3 thereby releases the outlet opening 3.1; light-curable material is dispensed because of that when the reservoir 1 is actuated. The further the closure unit 3, which is designed to be a type of rotary closure, is opened, the larger the gap between the massive tip 13.3 and the outlet opening 3.1 and the greater the amount of material that can be dispensed, which is why proportioning of the material to be dispensed is possible.

The snap-on device 7 with the LED 9 and the LED housing 9.1 is shown in FIG. 1. It can be mounted on the prepared mounting area 11 in accordance with FIG. 13.

Figure 18:
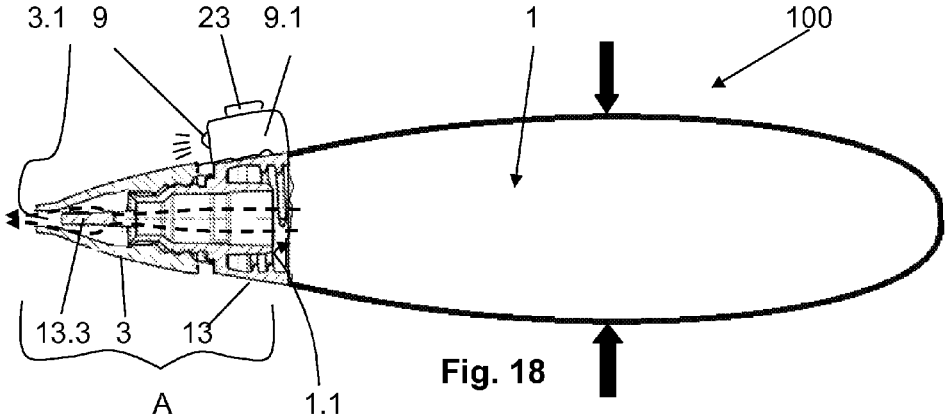
FIG. 18 shows an applicator 100 in which the LED is arranged in an LED housing designed to be on the receptacle unit.
Figure 19:
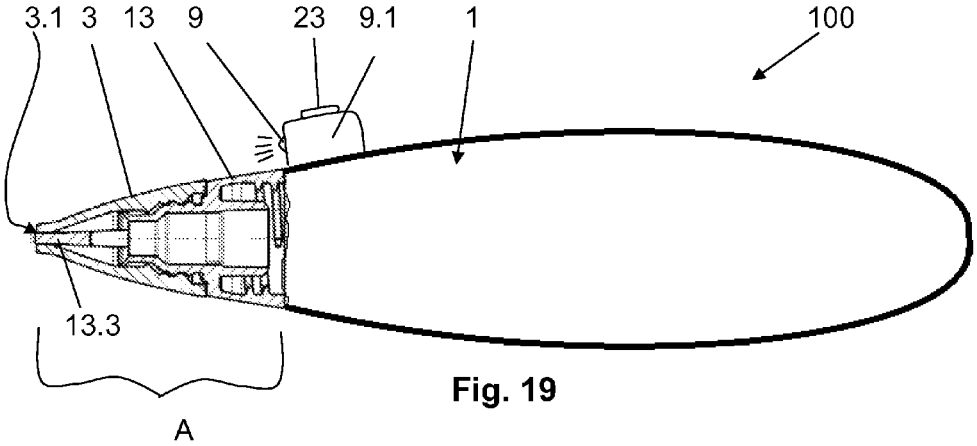
FIG. 19 shows an applicator 100 in which the LED is arranged in an LED housing designed to be on the reservoir.
Figure 20:
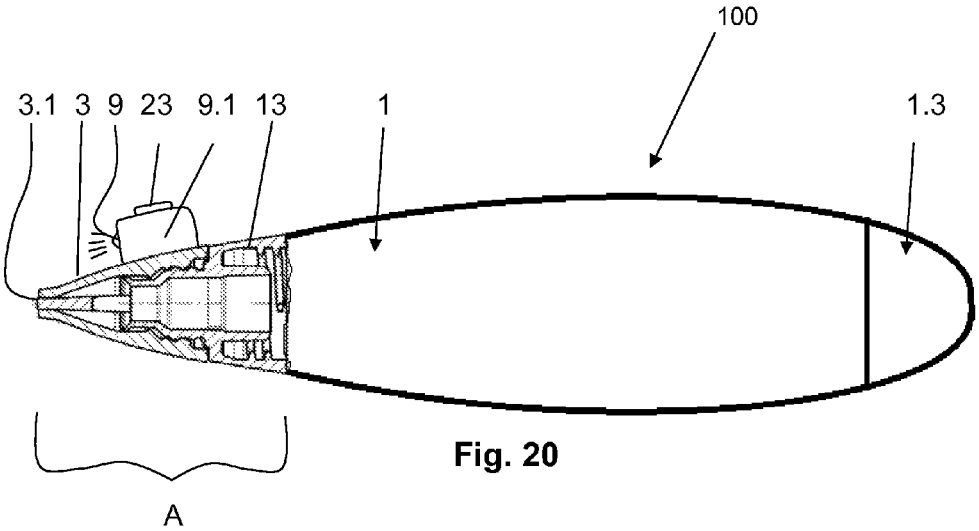
FIG. 20 shows an applicator 100 in which the LED is arranged in an LED housing designed to be on the closure unit.

FIGS. 18 to 20 show an applicator 100 in a schematic diagram; the LED 9 is integrated into an LED housing 9.1 on it. A switch, preferably a pushbutton switch 23 to actuate the LED 9, exists on the LED housing 9.1. The dispensing unit A, comprised of the receptacle unit 13 and the closure unit 3, is arranged on the reservoir 1 in all of the examples in accordance with FIGS. 18 to 20. The closure unit is designed to be a type of turn-lock closure and has an outlet opening 3.1 that is sealed by the massive tip 13.3 of the receptacle unit in the closed state (FIGS. 19 and 20) and that is released by the massive tip 13.3 in the open state after rotation of the closure unit 3 (FIG. 18) so that the curable material can be dispensed when the reservoir 1 is pressed together via manual actuation. Shielding does not exist here, because it is not required when the light of the LED lamp 9 cannot penetrate the closure unit 3. The closure unit 3 is therefore made of an appropriate opaque plastic or material (e.g. made of a metallic material); this prevents the light of the LED lamp 9 from curing the light-curable material before being dispensed form the outlet opening 3.1.

In a preferred variant, the LED housing 9.1 and the receptacle unit 13 are designed to be one piece, e.g. via an injection-molding process, in accordance with FIG. 18. The closure unit 3 is open in this presentation. If pressure is exerted on the wall of the reservoir 1, as indicated by the thick arrow, the light-curable material in it is moved through the opening 1.1 of the reservoir 1 into the receptacle unit 13 and the closure unit 3 and can be dispensed through the outlet opening 3.1 (see the dashed-line arrows), because a gap exists between the massive tip 13.3 and the outlet opening 3.1.

It is also possible in accordance with FIG. 19 to mold the LED housing 9.1 onto the wall of the reservoir 1 or to design them to be one piece or to clip it on.

FIG. 20 shows a further variant. In this figure, the LED housing 9.1 is arranged in the area of the closure unit 3 or is designed to be one piece with it.

It is also possible to design the reservoir 1 to be refillable. The filling can be done through the opening 1.1. when the dispensing unit A is fastened to the reservoir 1 in a detachable way. Otherwise, a filling opening can be provided in the wall of the reservoir 1. It can be provided on the end opposite the dispensing unit A and is closed, for instance, with a detachable end cap 1.3 in accordance with FIG. 20. In accordance with an example that is not shown, the LED lamp 9 with the LED housing 9.1 can also be arranged between the dispensing unit A and the reservoir 1 (e.g. via a clamp connection); a corresponding flow of material has to then be ensured.

Furthermore, it is possible for the LED housing 9.1 with the snap-on device, fastened via a snap-on connection, to at least partially surround the reservoir 1 and the receptacle unit A and to therefore prevent the receptacle unit A from inadvertently being detached when it is screwed together with the reservoir 1. In accordance with an example that is not shown, the LED lamp of the applicator can also be screwed together with the reservoir or with the dispensing unit via a screw connection. One or more light sources, especially LEDs, that generate light in the visible wavelength range will preferably be used. Blue light in the wavelength range of 420 to 490 nm has proven to be particularly advantageous. The fact that the light in the visible wavelength range is harmless with regard to health issues is a major advantage.

LIST OF REFERENCE NUMERALS

100 Applicator
1 Reservoir
1.1 First opening
1.2 Second opening
1.3 End cap
3 Closure unit
**3*a*** Dispensing tip
3.1 Outlet opening

3.2 Through-hole opening
3.3 Internal thread
4 Sealing cap
5 Dosing channel
6 Adapter element
6.1 Ring-shaped element
6.2 Reduced-diameter area
7 Snap-on device
7.1 Second snap-on device
7.2 Receptacle
9 LED lamp
9.1 LED housing
11 Prepared mounting area
13 Receptacle unit
14 Smoothing device
13.1 Fastening ring
13.2 Through-hole opening
13.3 Massive tip
13.4 External thread
15 Shielding ring
16 Actuation area
17 Thread
19 Internal thread
20 Housing
21 Light guide
23 Pushbutton switch
A Dispensing unit
B Width
F Actuating force
H Height
L Longitudinal axis

The invention claimed is:

1. Arrangement of a light source on an applicator for manually controlled application of a light-curable composite material contained in a reservoir, wherein the applicator has a longitudinal axis and an outlet opening for the light-curable material on a front end, wherein at least one light source is arranged on or in the applicator or is capable of being connected to the applicator in such a way that the light of the light source illuminates the dispensed light-curable material and cures it when the light source is actuated in the direction of the front end of the applicator, wherein the at least one light source is designed as an LED lamp with one or more LEDs and directly radiates in the direction of the outlet opening of the applicator wherein the LED lamp can be moved from a position fastened to the applicator in which the LED points away from the outlet opening to a position fastened to the applicator in which the LED radiates in the direction of the outlet opening.

2. Arrangement according to claim 1, wherein the at least one light source can be fastened in a detachable way to the applicator.

3. Arrangement according to claim 1, wherein the light source is permanently integrated into a housing of the applicator in a visible or non-visible way.

4. Arrangement according to claim 1, wherein the LED housing is screwed together with the reservoir or the dispensing unit or that the LED lamp with its LED housing is designed to be one piece on the peripheral side with the reservoir or the dispensing unit or is injection-molded on the peripheral side onto the reservoir or the dispensing unit.

5. Arrangement according to claim 1, wherein the dispensing unit has a receptacle unit that is connected to the reservoir and a closure unit that has an outlet opening, wherein the LED lamp with the LED housing is fastened to or formed on the receptacle unit or the closure unit.

6. Arrangement of a light source on an applicator for manually controlled application of a light-curable composite material contained in a reservoir, the reservoir being connected to a dispensing unit for dispensing the light-curable composite material, wherein the applicator has a longitudinal axis and an outlet opening for the light-curable material on a front end, wherein at least one light source is arranged on or in the applicator or is capable of being connected to the applicator in such a way that the light of the light source illuminates the dispensed light-curable material and cures it when the light source is actuated in the direction of the front end of the applicator, wherein the at least one light source is designed as an LED lamp with one or more LEDs and directly radiates in the direction of the outlet opening of the applicator, wherein the LED lamp can be attached in a detachable or non-detachable fashion to the reservoir or to the dispensing unit for illuminating in the direction of the outlet opening, and wherein the LED lamp is arranged in an LED housing that can be fastened via at least one clip element to the reservoir on the peripheral side or to the dispensing unit or between the reservoir and the dispensing unit.

7. Arrangement of a light source on an applicator for manually controlled application of a light-curable composite material contained in a reservoir, wherein the applicator has a longitudinal axis and an outlet opening for the light-curable material on a front end, wherein at least one light source is arranged on or in the applicator or is capable of being connected to the applicator in such a way that the light of the light source illuminates the dispensed light-curable material and cures it when the light source is actuated in the direction of the front end of the applicator, wherein the at least one light source is designed as an LED lamp with one or more LEDs and directly radiates in the direction of the outlet opening of the applicator, wherein a light guide is routed at least in sections along the outside of the applicator from the LED in the direction of the outlet opening or is extended through a recess in a housing of the applicator from the LED to close to the outlet area of the light-curable material.

8. Arrangement according to claim 7, wherein the LED lamp can optionally be activated via a pressbutton switch, a contact switch or a capacitive sensor and the LED lamp has at least one battery for an electrical power supply.

9. Arrangement according to claim 7, wherein an electronic control unit exists for the LED lamp.

* * * * *